US005204587A

United States Patent [19]

Mortimer et al.

[11] Patent Number: 5,204,587

[45] Date of Patent: Apr. 20, 1993

[54] FLUORESCENT LAMP POWER CONTROL

[75] Inventors: George W. Mortimer; Robert V. Burke, both of Fort Wayne, Ind.

[73] Assignee: MagneTek, Inc., Los Angeles, Calif.

[21] Appl. No.: 657,114

[22] Filed: Feb. 19, 1991

[51] Int. Cl.[5] ..... H05B 37/02

[52] U.S. Cl. ..... 315/308; 315/307; 315/208; 315/224

[58] Field of Search ..... 315/307, 308, 208, 224

[56] References Cited

U.S. PATENT DOCUMENTS

| | | | |
|---|---|---|---|
| 3,270,184 | 8/1966 | Negromanti | 307/257 |
| 3,323,013 | 5/1967 | Lord | 315/DIG. 4 |
| 3,463,964 | 8/1969 | Privett et al. | 315/247 |
| 3,573,544 | 4/1971 | Zonis | 315/206 |
| 3,679,935 | 7/1972 | Jacques et al. | 315/DIG. 4 |
| 3,911,320 | 10/1975 | Crawford et al. | 315/240 |
| 4,259,614 | 3/1981 | Kohler | 315/224 |
| 4,277,726 | 7/1981 | Burke | 315/98 |
| 4,284,925 | 8/1981 | Bessone et al. | 315/DIG. 4 |
| 4,289,993 | 9/1981 | Harper et al. | 315/311 |
| 4,353,009 | 10/1982 | Knoll | 315/DIG. 4 |
| 4,358,711 | 11/1982 | Bex | 315/208 |
| 4,371,812 | 2/1983 | Widmayer | 315/208 |
| 4,392,086 | 7/1983 | Ide et al. | 315/DIG. 4 |
| 4,456,855 | 6/1984 | Sairanen | 315/308 |
| 4,469,988 | 9/1984 | Cronin | 315/209 R |
| 4,498,031 | 2/1985 | Stupp et al. | 315/224 |
| 4,527,099 | 7/1985 | Capewell | 315/226 |
| 4,560,908 | 12/1985 | Stupp et al. | 315/DIG. 7 |
| 4,686,427 | 8/1987 | Burke | 315/219 |
| 4,700,111 | 10/1987 | Folwell et al. | 315/200 R |
| 5,034,663 | 7/1991 | Cook | 315/308 |

OTHER PUBLICATIONS

Advance Information ML4813 Buck-Boost Power Factor Controller.

SG1595/SG1495 Four-Quadrant Multiplier.

*Primary Examiner*—Paul M. Dzierzynski
*Assistant Examiner*—R. A. Ratliff
*Attorney, Agent, or Firm*—Faegre & Benson

[57] ABSTRACT

A fluorescent lamp power control having an input conditioning section, a lamp driver section, and a power command interface and control section to control power to fluorescent lamps. An external power command input is compared to an internally generated, computed power level and an electronic preregulator is controlled to regulate amp power. The preregulator output voltage and lamp driver current are multiplied to obtain a signal indicative of lamp power. A power command interface isolates the external power command input. Fluorescent lamp dimming is achieved by reducing the external power command input signal, reducing the power delivered to the fluorescent lamps.

15 Claims, 4 Drawing Sheets

FLUORESCENT LAMP POWER CONTROL

BACKGROUND OF THE INVENTION

In the past, it has been known to control fluorescent lamps through the use of electronic ballasts wherein the lamp current was controlled by controlling the operating frequency of the ballast. In such ballasts the lamp voltage was ordinarily uncontrolled. This necessitated different circuits for different wattage lamps in order to avoid over or under powering the lamps.

The present circuit overcomes deficiencies of the prior art by controlling lamp power and provides for easy dimming of fluorescent lamps by matching lamp power to an externally variable reference signal, providing variable lamp brightness.

DETAILED DESCRIPTION

Figure 1:
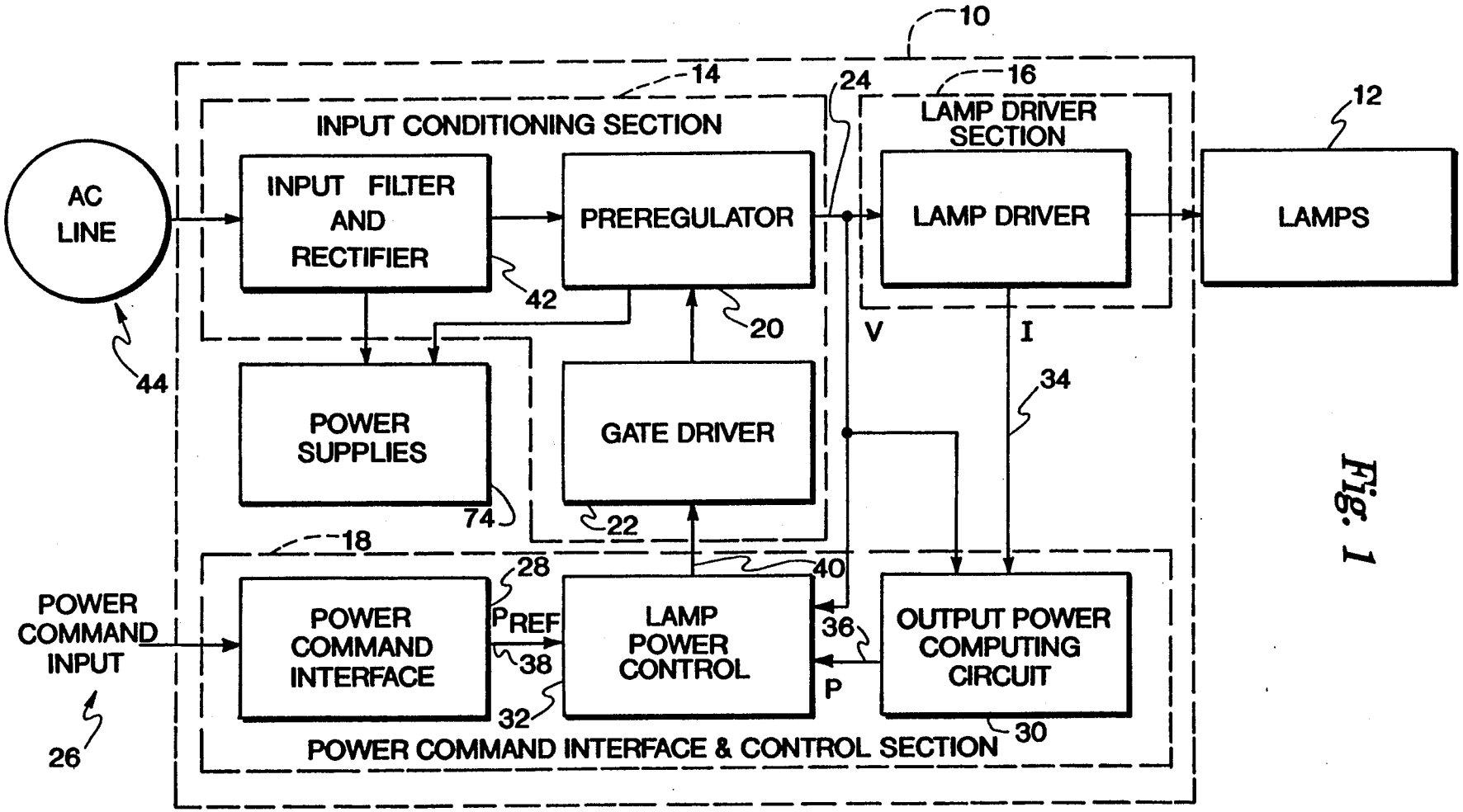
FIG. 1 shows a block diagram of the overall lamp control system.
Figure 2:
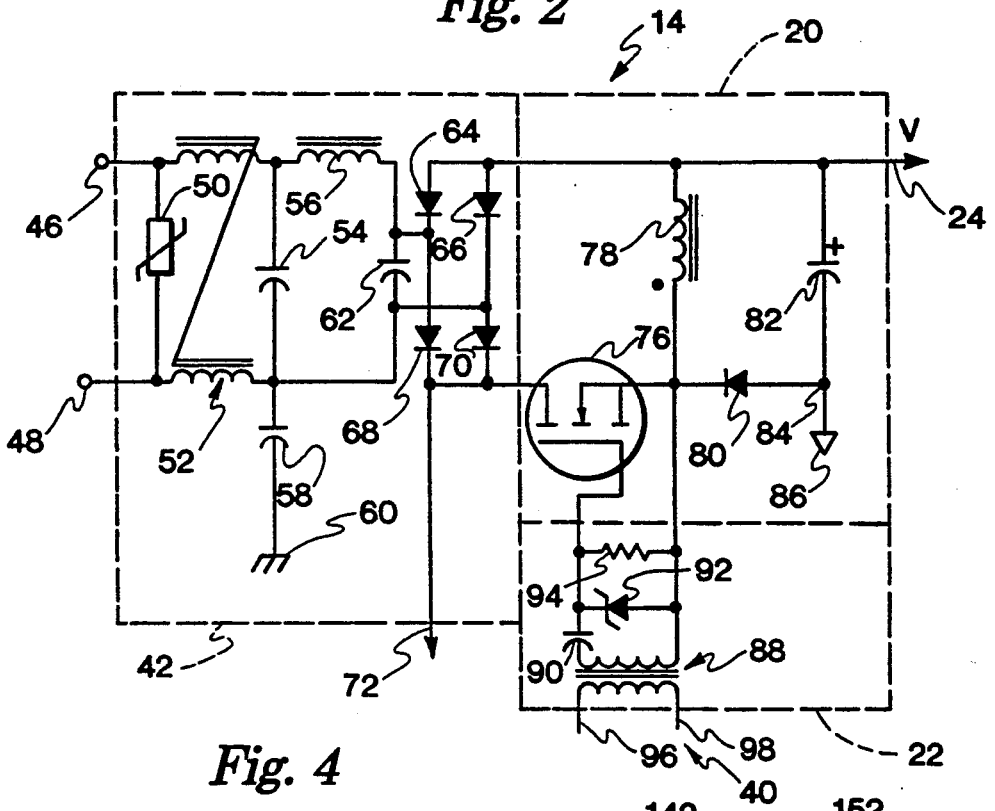
FIG. 2 shows an Input Filter and Rectifier, Preregulator, and Gate Driver useful in the practice of the present invention.

Referring to FIG. 1, the present invention is a high frequency, low harmonic distortion electronic ballast 10 for fluorescent lamps 12. It provides starting and excitation of two 40-watt (nominal) T12 fluorescent lamps and preferably operates from a 277 VAC nominal input power line. The ballast is capable of driving alternative lamp loads of two 34-watt T12 energy-saving lamps or two 32-watt T8 "octic" type lamps without alteration of the ballast.

The present invention can simultaneously provide less than 10% total harmonic distortion, greater than 90% efficiency, and greater than 98% power factor. It also provides externally-controllable lamp dimming over a range greater than 20% to substantially 100% of rated lamp output intensity.

The ballast 10 has three major sections: an Input Conditioning section 14, which provides active power factor correction and voltage preregulation; a Lamp Driver section 16 which provides a high-frequency excitation for the lamps; and a Power Command Interface and Control section 18 which provides a signal to a preregulator 20 through a gate driver 22 in input conditioning section 14 to control a preregulator output on line 24 in response to an external command 26 in order to adjust intensity of lamps 12.

The Input Conditioning section 14 preferably includes a discontinuous-mode flyback pulse width-modulated (PWM) power converter, providing a regulated DC voltage to the Lamp Driver section 16. The use of the discontinuous mode flyback topology enables power factor correction by operating the converter to make average current at any point on the line voltage cycle proportional to the input AC line voltage 44. It also allows the output DC on line 24 provided to the Lamp Driver 16 to be either greater or less than the peak AC input voltage 44, thereby allowing greater latitude in the value of the DC level on line 24 and simplifying the problem of varying the bus voltage on line 24.

The Lamp Driver section 16 preferably includes a current-fed, parallel-resonant DC-AC power converter. By using a parallel-resonant approach, a constant DC current load is presented to the Input Conditioning section or circuit 14 on line 24. By varying the DC input voltage to the Lamp Driver section 16, the output intensity of lamps 12 can be adjusted.

The Power Command Interface and Control section 18 preferably includes a Power Command Interface circuit 28, an Output Power Computation circuit 30, and a Lamp Power Control circuit 32. The Power Computation circuit 30 samples the preregulator output voltage signal V on line 24 and the Lamp Driver current signal I on line 34 and multiplies them to provide a computed power signal P on line 36 which approximates lamp power. Computed power P is provided via line 36 to the lamp power control circuit 32. The Power Command Interface circuit 28 provides isolation and conditioning of the external power command input signal 26. The command signal 26 is isolated and conditioned to generate a lamp power reference ($P_{ref}$) signal on line 38. By applying the feedback and reference signals 36, 38 to the Lamp Power Control 32, an error signal 40 (using pulse width modulation) is generated which is used by the preregulator 20 in the Input Conditioning section 14 to regulate the DC bus voltage on line 24. In this manner, the amount of power delivered to the lamps 12 is controlled to the level specified by the power command input signal 26.

Referring now also to FIGS. 2–7, the description of the various circuits is as follows:

An Input Filter and Rectifier circuit 42 is preferably connected to the AC line 44 of 277 volts, 60 Hz via terminals 46, 48. A conventional MOV 50 is preferably connected across terminals 46, 48 to protect against incoming voltage transients. A 15 mH inductor 52, a 0.47 mf capacitor 54 and a 3 mH inductor 56 provide input filtering for the power supplied on lines 46, 48. A 3300 pf capacitor 58 provides AC coupling to chassis ground 60. A 0.68 mf capacitor 62 provides additional filtering. A full-wave bridge is made up of diodes 64, 66, 68, 70 which may be a 1N4007 type. A lead 72 provides power from the rectifier bridge to the Power Supply section 74.

In the Preregulator 20, a type IRFBC40 FET 76, available from International Rectifier, operates as a switching device. FET 76 is connected to an output portion of preregulator 20 having a 600 uH, 55 turn inductor 78, a fast recovery diode 80 and a 220 mf capacitor 82. A junction 84 between diode 80 and capacitor 82 serves as circuit common as indicated throughout the various figures by symbol 86. FET 76 is powered by Gate Drive circuit 22 having a conventional 3 to 2 step down transformer 88, a 0.33 mf capacitor 90, a 18 volt zener diode 92, and a 1K resistor 94. Leads 96, 98 together make up a path for the error signal 40 (which serves as a Gate Drive signal) from the Lamp Power Control 32 of FIG. 6.

Figure 3:
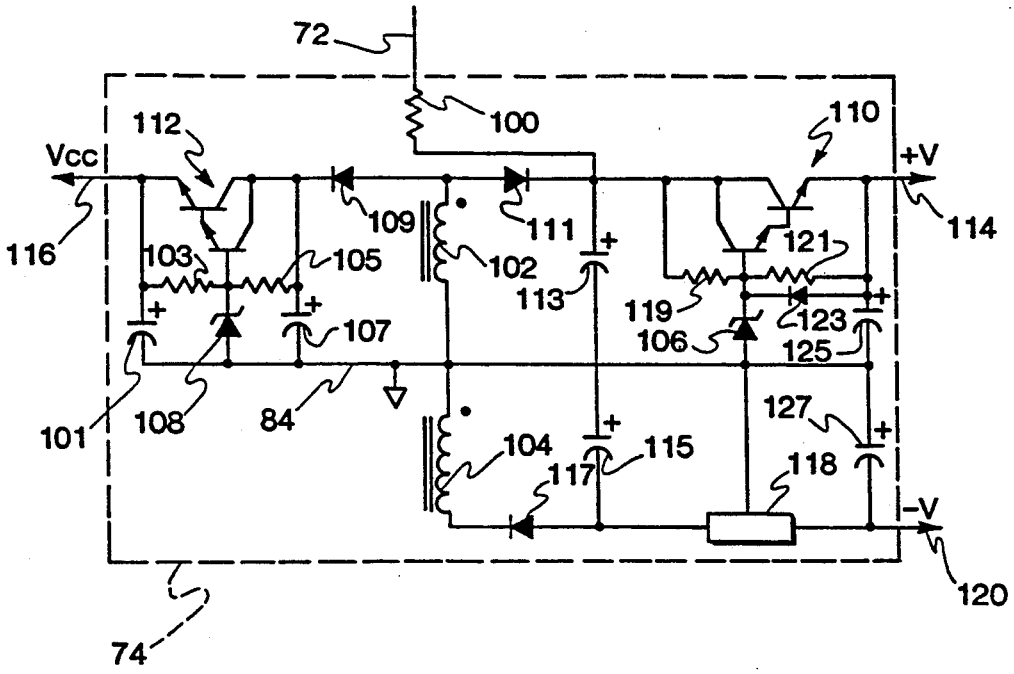
FIG. 3 shows a detailed electrical schematic for the Power Supplies useful in the practice of the present invention.

Referring now more particularly to FIG. 3, the Power Supply section or circuit 74 may be seen. Electrical power supplied via lead 72 from the Input Filter and Rectifier circuit 42. Electrical power on lead 72 is delivered through a 100K resistor 100 for start-up purposes. In addition, windings 102 and 104 are secondaries (of 6 and 3 turns, respectively) wound on a common core with inductor 78. Windings 102 and 104 operate as transformer secondaries to provide power for the Power Supply circuitry 74. A 24 volt zener diode 106 and a 16 volt zener 108 operate in combination with their respective darlington transistors 110, 112 to provide, respectively, +24 volts at the +V bus 114 and +15 volts at the Vcc bus 116. A type LM79L12 voltage regulator 118 provides a −12 volts at the −V bus 120.

Figure 4:
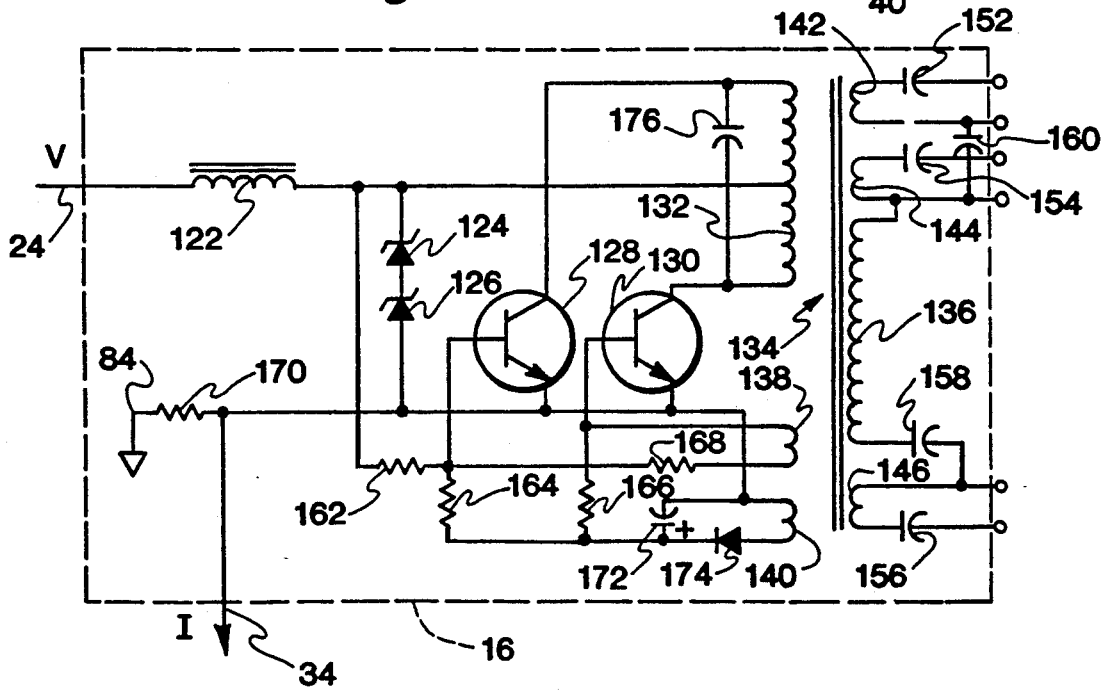
FIG. 4 shows a detailed electrical schematic of a push-pull type Lamp Driver useful in the practice of the present invention.

Referring now to FIG. 4, Lamp Driver circuit 16 preferably includes a series 8 mH inductor 122 connected to the DC bus V 24. Lamp Driver 16 also includes a voltage clamp made up of a pair of zener diodes 124, 126. Diode 124 is preferably a 180 volt, 1N4192B type and diode 126 is preferably a 150 volt, 1N4190B type. A pair of transistors 128, 130 each of which are preferably fast switching, high voltage type are connected to opposite ends of a center-tapped primary 132 of 76 turns of a power transformer 134. Transformer 134 also preferably has a secondary 136 of 112 turns, a feedback winding 138 of 2 turns, a bias winding 140 of 1 turn, and filament windings 142, 144, 146 each of 2 turns. Winding 142 is AC coupled to the lamp load via a 1.5 mf capacitor 152. Windings 144 and 146 are coupled via 0.82 mf capacitors 154 and 156, respectively. Winding 136 is coupled via a 0.0043 mf capacitor 158; and a 250 pf capacitor 160 completes the output network of Lamp Driver 16. Lamp Driver 16 also includes a 120K resistor 162, a pair of 360 ohm resistors 164, 166 and a 1.5 ohm resistor 168. A −1 ohm, 1 watt wire-wound resistor 170 is used to provide current feedback on line 34. A 47 mf capacitor 172 and a fast recovery diode 174 complete the circuit for winding 140. A 0.0047 mf capacitor 176 is preferably connected across center-tapped winding 132.

Figure 5:
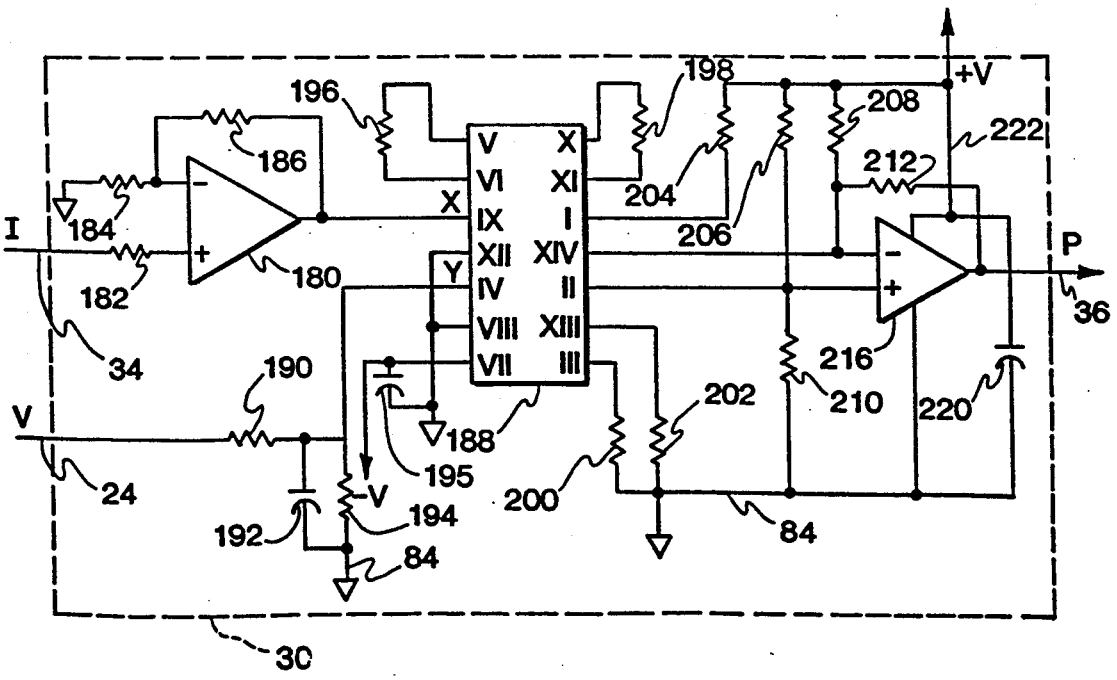
FIG. 5 shows a detailed electrical schematic of an Output Power Computing circuit useful in the practice of the present invention.

Referring now to FIG. 5, the details of the output power computing circuit 30 may be seen. The lamp current signal I is received on line 34 from the Lamp Driver section 16 and the lamp voltage signal V is received on line 24 from Preregulator 20. The current signal 34 is fed through a 10K resistor 182 to an operational amplifier which may be a one-half of a type LM358 integrated circuit, as available from National Semiconductor. A 10K scaling resistor 184 and a 90.9K feedback resistor 186 set the gain for op amp 180. A four quadrant linear or analog multiplier 188 (which is preferably a SG1495 integrated circuit available from Silicon General) receives and multiplies the current and voltage signals I and V together. Voltage signal V is signal conditioned and filtered by a network made up a 475K resistor 190, a 0.01 mf capacitor 192, and 24.9K resistor 194. Multiplier 188 has supporting circuitry including a 0.1 mf capacitor 195, a pair of 15K resistors 196, 198, and a pair of 12K resistors 200, 202. Pin numbers for the multiplier IC 188 are shown in roman numerals. A 2K resistor 204, a pair of 1.5K resistors 206, 208, and a pair of 11K resistors 210, 212, make up a biasing and scaling network for operational amplifier 216 which may the other half of the LM358 integrated circuit used for op amp 180. A 0.1 mf capacitor 220 provides for noise filtering on the +V connection 222 to op amp 216.

Figure 6:
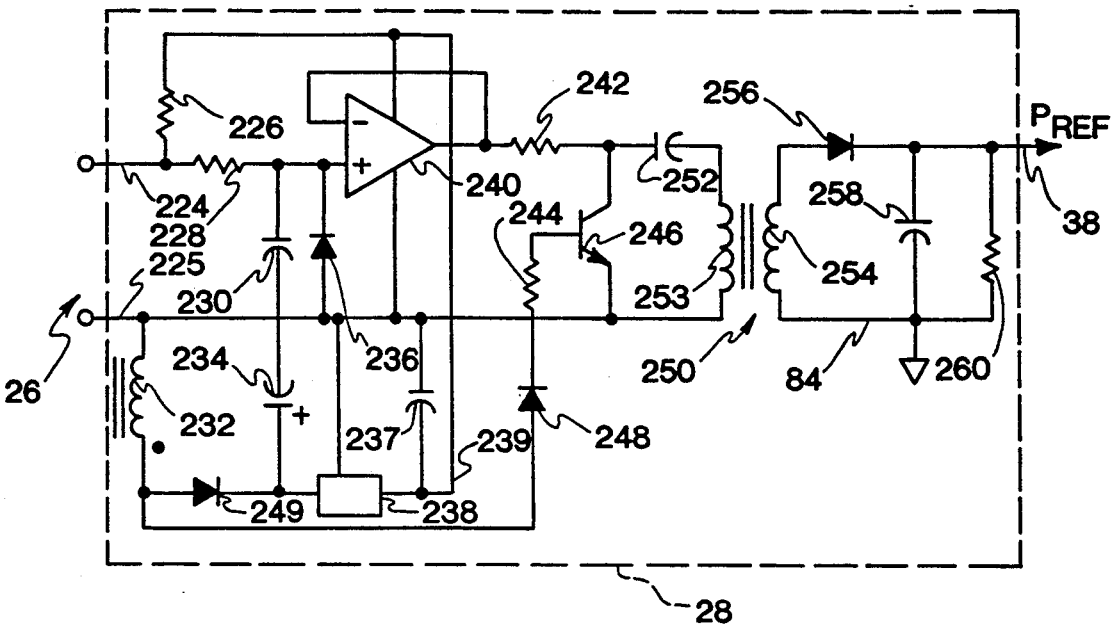
FIG. 6 shows a detailed electrical schematic of a Power Command Interface useful in connection with the practice of the present invention.

Referring now to FIG. 6, leads 224 and 225 together make up the input connections for external command 26. A 150K resistor 226 provides a bias voltage, and a 100K resistor 228 serves as a summing resistor for the non-inverting input of op amp 240. A 0.01 mf capacitor 230 and a 12 volt zener 236 are connected between the non-inverting summing junction 231 and the external command input common 225. Power to op amp 240 is provided by a secondary 232 of 4 turns wound on a common core with winding 78. A diode 249 and 10 mf capacitor 234 provide an unregulated supply to a linear voltage regulator 238 which may be of the type LM78L15 available from National Semiconductor, and which provides a +15 output at lead 239. A 10 mf capacitor 237 provides output filtering. The output of op amp 240 is connected through a 10K resistor 242 to the collector of a NPN transistor 246. A diode 248 and a 10K resistor 244 are connected between winding 232 and the base of 246. A 0.22 mf capacitor 252 is connected in series with a primary 253 of a 1 to 1 turns ratio isolation transformer 250. A secondary winding 254 is connected to a diode 256 and a 0.1 mf capacitor 258 having a 100K load resistor 260.

Figure 7:
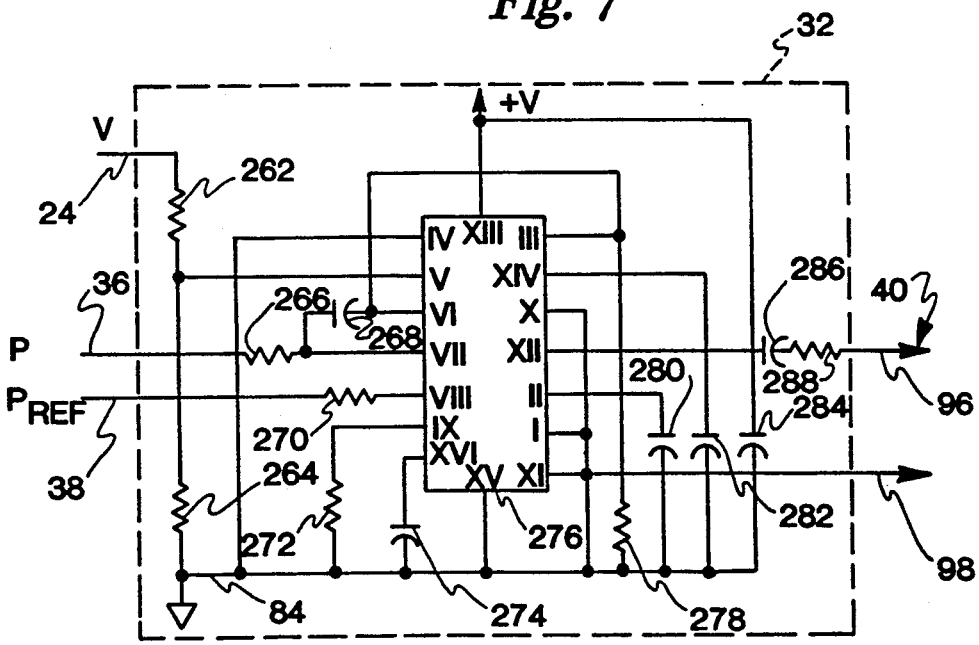
FIG. 7 shows a preregulator control circuit or Lamp Power Control useful in the practice of the present invention.

Referring now to FIG. 7, the details of the Lamp Power Control circuit 32 may be seen. This circuit utilizes a buck-boost power factor controller 276 which preferably is a type ML4813 IC available from Micro Linear Corporation, 2092 Concourse Drive, San Jose, Calif. 95131. Roman numerals within integrated circuit 276 referred to pin numbers of the integrated circuit. A 475K resistor 262 is connected between the DC bus 24 and pin V of IC 276. A 16.8K resistor 264 completes a voltage divider with resistor 262. A pair of 100K resistors 266, 270, serve as summing resistors. A 0.22 mf capacitor 268 is connected between VI and VII of IC 276. A 2K resistor 272, a 0.001 mf capacitor 274, a 1K resistor 278, 30.1 mf capacitors 280, 282 and 284 support IC 276. The output of controller 276 is provided from 10 XII through a 0.22 mf capacitor 286 and a 22 ohm resistor 288 to provide the error signal on line 40. It is to be understood that the signal is provided on lead 96 while 98 is connected to circuit common 84 (note also FIG. 2).

The operation of the electronic ballast 10 is as follows. The Input Filter and Rectifier 42 provides a full wave rectified DC supply from AC line 44 to Preregulator 20. In addition, a small amount of power is supplied via lead 72 to the Power Supply circuitry 74. Preregulator 20 operates with switching device 76, inductor 78, diode 80 and capacitor 82 in a flyback mode with pulse-width modulation controlled by IC 276 in the Lamp Power Control 32 (FIG. 7). Preregulator 20 is driven through gate driver 22 at a frequency of 40 KHz. Inductor 78 also serves as the primary for a transformer having secondaries 102, 104 in the Power Supply circuitry 74 and secondary 232 in the Power Command Interface 28 (FIG. 6).

Lamp voltage is approximated by the DC bus voltage V at line 24 and lamp current is closely approximated by transistor current in the Lamp Driver circuit 16. Transistor current is passed through resistor 170 to provide a voltage signal I proportional to lamp current on lead 34.

Signals 24, 34 are provided to the Output Power Computing circuit 30 (FIG. 5). Current signal 34 is amplified and voltage signal 24 is attenuated to bring each into a range suitable for analog multiplication in IC 188. Op amp 216 provides output buffering and level shifting, presenting a computed power output P on line 36. The computed power output P is the product of the bus voltage and current and it is to be understood that their product is closely representative of instantaneous lamp power. Lamp power is thus computed and controlled without the use of expensive transducing and isolating circuitry which would be necessary if the voltage and current were to be measured in the secondary of 136.

The power command input can be in either analog voltage form in the range of 0 to 10 volts or a pulse-width modulated signal in the range of 0 to 100% modulation with a modulating frequency above 1 KHz. Power command input signal 26 is isolated by transformer 250 and is remodulated at the frequency of preregulator 20 by transistor 246 driven from secondary 232. The power command input signal 26 is reconstituted as the $P_{ref}$ signal 38 on the secondary side of transformer 250. Because of the closed-loop characteristic of this electronic ballast 10, the computed power 36 is compared to the reference power 38 by the Lamp Power Control 32, more specifically by the integrated circuit 276. By providing a reduction in the power command input 26, dimming of lamps 12 may be achieved over the range of 100% to less than 20%.

It may be seen that this invention is capable of providing a choice of enhancing illumination or efficiency simply by utilizing standard (40W), energy-saving (34W), or "octic" (32W) lamps without changing the ballast 10.

For example, an increased level of luminance may be obtained by replacing standard lamps with energy-saving lamps and still further increased illumination may be achieved by using "octic" type lamps, all without any change to the ballast 10 or to the reference signal 26. In this mode, the ballast operates at constant power output, preferably nominally 33 watts, and using the ballast 10 at this power level with standard 40 watt rated lamps provides substantially the same illumination as would be obtained with standard lamps operating at 40 watts (nominal) from a conventional (non-electronic) ballast at 60 Hertz.

Operating at 33 watts (or another intermediate power level) allows substitution of 34-watt rated energy-saving lamps for standard 40-watt rated lamps without altering ballast 10 or reference signal 26. Similarly, operation at an appropriate intermediate power level (such as, but not limited to 33 watts) allows installation of 32-watt rated "octic" lamps as the lamp load 12, 260 again without changing ballast 10 or reference signal (which may be internally supplied).

By providing substantially constant power operation the present invention allows a single ballast to be used in a variety of applications and Permits a degree of flexibility to illumination designers and users heretofore not readily attainable.

Alternatively, the maximum value of the input reference signal 26 can be reduced when standard lamps are replaced with energy-saving type lamps to obtain the same luminance again without any change required in ballast 10.

The highest efficiency can be obtained by reducing the input reference signal 26 still further and utilizing "octic" type lamps, again without altering ballast 10 in any way.

It may thus be seen that a single ballast may be used (without alteration) by illumination designers and users to adjust illumination solely by substituting one lamp type for another; efficiency (at a given level of illumination) may be improved by upgrading from a less efficient lamp to a more efficient lamp (e.g., changing from the standard type to the energy-saving type or to the "octic" type) solely by reducing the input reference signal 26 to obtain an illumination level obtainable from the lamp type upgraded from.

As a still further alternative, improvements in both luminance and efficiency may be obtained by a combination of lamp replacement and a (partial) reduction in the input reference signal 26 again without alteration of ballast 10.

The invention is not to be taken as limited to all of the details thereof as modifications and variations thereof may be made without departing from the spirit or scope of the invention.

What is claimed is:

1. Apparatus for controlling a fluorescent lamp comprising:

a) a discontinuous-mode flyback type preregulator receiving power from and providing power factor correction at an AC power line and providing a controllable DC electrical output;

b) a lamp driver having a DC input connected to the DC output of the preregulator and having an output adapted to be connected to a fluorescent lamp such that the output power of lamp driver depends on the voltage level of said DC input;

c) first means for providing an output representative of a voltage across the lamp;

d) second means for providing an output representative of a current through the lamp;

e) multiplier means for multiplying the outputs of the first and second means; and for providing a signal representative of lamp power; and f) power control means for controlling the output of the preregulator is response to the signal representative of lamp power to hold lamp power constant in the event of variations in the AC power line.

2. The apparatus of claim 1 further comprising at least one fluorescent lamp connected to the lamp drive output.

3. The apparatus of claim 2 wherein the fluorescent lamp comprises a T12 standard type lamp.

4. The apparatus of claim 2 wherein the fluorescent lamp comprises a T12 energy-saving type lamp.

5. The apparatus of claim 2 wherein the fluorescent lamp comprises a T8 "octic" type lamp.

6. Apparatus for controlling a fluorescent lamp comprising:

a) a discontinuous-mode flyback type preregulator operating from and providing power factor correction at an AC power line and providing a variable-output DC voltage at a power output thereof and having a signal input;

b) a self-oscillating lamp ballast circuit having a DC input connected to the power output of the preregulator such that output power of lamp ballast depends on the voltage level of said DC input;

c) power computing means for computing and providing at an output thereof a signal representative of output power delivered to a fluorescent lamp by the lamp ballast;

d) a pulse-width modulator having:

i) an input connected to the output of the power computing means, and ii) an output providing a pulse-width modulated signal to the signal input of the preregulator wherein the preregulator is controlled by the pulse-width modulator to maintain the output power constant.

7. A method of controlling a fluorescent lamp comprising the steps of:

a) operating a discontinuous-mode flyback type preregulator from an AC power line supply voltage to provide a controllable DC voltage output and power factor correction at the AC power line;

b) operating a lamp driver powered by the preregulator DC voltage output to provide a lamp voltage and a lamp current to power a fluorescent lamp;

c) computing power supplied to the lamp by multiplying signals representative of lamp voltage and current; and d) controlling the preregulator output such that electrical power supplied to the lamp is regulated to a constant value as an RMS value of the AC power line supply voltage varies.

8. The method of claim 7 wherein step c) further comprises controlling the preregulator output to maintain the product of lamp current and lamp voltage substantially constant.

9. The method of claim 7 further comprising adjusting lamp luminance by selecting a lamp load from among standard, energy-saving and "octic" type fluorescent lamps and powering the selected lamp at a predetermined power level independent of the type of lamp selected.

10. The method of claim 7 wherein step c) further comprises sensing the preregulator output voltage and a preregulator output current and comparing the product thereof against a reference input signal and regulating the preregulator output voltage to minimize the difference between the reference input signal and the product.

11. The method of claim 10 wherein step c) further comprises regulating lamp power by adjusting the preregulator output voltage.

12. The method of claim 7 further comprising adjusting operating efficiency by selecting one type of lamp load from among standard, energy-saving and "octic" type fluorescent lamps and adjusting the reference input signal to obtain a lamp luminance corresponding to a luminance obtainable from a fluorescent lamp type not selected.

13. A method of controlling a fluorescent lamp comprising operating an electronic ballast having a discontinuous-mode flyback type preregulator with a controllable DC voltage output connected as an input to a self-oscillating lamp driver whose input voltage and current are proportional to fluorescent lamp voltage and current by computing lamp power as the product of the input voltage and current of the lamp driver and regulating the lamp driver to hold lamp power constant by adjusting the DC voltage level of the output from the preregulator and simultaneously making average current proportional to an AC line voltage at the input to the preregulator to provide power factor correction at the AC line.

14. The method of claim 13 wherein the electronic ballast further comprises means for receiving an external reference signal and the method further comprises regulating lamp power to a level set by a level of the external reference signal.

15. The method of claim 13 further comprising dimming the fluorescent lamp by reducing the external reference signal.

* * * * *